US009352475B2

(12) United States Patent
Nasrallah

(10) Patent No.: US 9,352,475 B2
(45) Date of Patent: May 31, 2016

(54) MAGNETIC KNIFE BLADE WIPER

(71) Applicant: Jeffrey W. Nasrallah, Honolulu, HI (US)

(72) Inventor: Jeffrey W. Nasrallah, Honolulu, HI (US)

(73) Assignee: Prodius LLC, Honolulu, HI (US)

( * ) Notice: Subject to any disclaimer, the term of this patent is extended or adjusted under 35 U.S.C. 154(b) by 134 days.

(21) Appl. No.: 14/447,565

(22) Filed: Jul. 30, 2014

(65) Prior Publication Data

US 2016/0031111 A1 Feb. 4, 2016

(51) Int. Cl.
*B26B 11/00* (2006.01)
*B26D 7/18* (2006.01)

(52) U.S. Cl.
CPC . *B26B 11/00* (2013.01); *B26D 7/18* (2013.01); *B26D 2007/1809* (2013.01)

(58) Field of Classification Search
CPC ... B26B 11/00; B26D 7/18; B26D 2007/1809
USPC ..... 30/123, 136, 169, 136.5
See application file for complete search history.

(56) References Cited

U.S. PATENT DOCUMENTS 520,818 A * 6/1894 Bettinger ..... H02G 1/1214 15/236.06
1,280,835 A * 10/1918 Preston ..... B26B 3/04 30/128
2,140,209 A * 12/1938 Rietveld ..... A47L 21/00 15/236.09
4,495,668 A * 1/1985 Adams ..... A47L 1/16 15/105
4,570,339 A * 2/1986 Taylor ..... A47J 43/28 222/80
4,937,940 A * 7/1990 Mason ..... B26B 21/40 30/136
6,964,078 B2 * 11/2005 Schwab ..... B08B 1/00 15/218.1
D622,468 S * 8/2010 Parker ..... B08B 1/00 D32/42
8,584,365 B2 11/2013 Zeitlin
2009/0165307 A1 * 7/2009 Lam ..... A47G 21/103 30/123
2010/0307008 A1 12/2010 Zeitlin

* cited by examiner

*Primary Examiner* — Sean Michalski
(74) *Attorney, Agent, or Firm* — Leighton K. Chong

(57) ABSTRACT

A magnetic knife blade wiper, for use with knives of standard types and sizes, has a pair of wiper blades spaced apart in parallel to fit onto the side surfaces of a knife blade. A device housing is attached to upper ends of the pair of wiper blades and has a permanent magnet carried in a cavity therein for holding the wiper magnetically on the spine of the knife blade. The wiper can be moved along the blade toward the knifepoint to wipe off any food debris on the side surfaces of the blade. The wiper blade length is sized to be less than the height of the blade so that the wiper can remain in position proximate the hilt of the knife without interfering with cutting operations. The wiper blades have a thin profile so that, when positioned proximate the hilt of the knife, they do not project beyond the girth of the knife in order not to interfere with the user's sightlines or cutting operations.

15 Claims, 5 Drawing Sheets

MAGNETIC KNIFE BLADE WIPER

FIELD OF INVENTION

The subject matter disclosed herein generally relates to a knife accessory used to wipe debris from the sides of a knife blade. In particular, it is directed to a magnetic knife blade wiper that can be readily positioned and used for wiping on a knife blade.

BACKGROUND ART

Knives are commonly used for cutting in food preparation and may be of a variety of types, such as chef's knife, cook's knife, butcher's knife, kitchen knife, bread knife, paring knife, carving knife, and the like. A chef's knife is an all-purpose knife used in the kitchen for cutting any type of food and some knife designs have some degree of curve to allow the cook to rock the knife on the cutting board for a more precise cut. The broad and heavy blade of the chef's knife also serves for chopping bone instead of the cleaver making it an all-purpose knife for food preparation. Chefs knives are most commonly available between 6 and 12 inches, although 8 inches is the most common size.

A common problem experienced when cutting food with a knife is that debris from the food being cut sticks to the side surfaces of the knife blade. Recipes typically require food to be cut to a particular size and dimension, therefore if food debris remains stuck to the sides of the knife blade during cutting or chopping, it needs to be removed so that the user can continue to accurately achieve the desired cut dimensions. When cutting, chopping, slicing or mincing food, it is also a commonly experienced problem that debris from the cut food adheres to the blade and slows the food preparation process because the food preparer must manually remove the food debris from each side of the blade. Manually pushing off the cut food debris from the blade is typically done by carefully sliding a finger across the blade side to knock off the food pieces adhering to the blade, then perform the same action on the opposite blade side. This procedure must be done slowly and cautiously as it can be dangerous for the food preparer.

Knife designers and manufacturers have understood the need for knife designs that can reduce or prevent cut food adhesion to the side surface areas of a knife blade. Knife manufacturers have incorporated surface features into a knife blade with the intent of making it easier for cut food to release from the blade and to prevent food adhesion. Knife blade designs intended to reduce food adhesion to the blade all revolve around the same principal of reducing surface tension between the blade and the cut food and or attempting to push the cut food away from the blade. Three common blade design features that are used for reducing cut food adhesion include: (1) small smooth indentations ground into the blade surface; (2) blade holes that are complete holes through the blade; and (3) protruding ridges that span nearly the entire length of the blade to reduce adhesion of cut food from the blade.

Some devices have been described in the prior art to address the need to safely remove cut food material from adhering to a knife blade. U.S. Published Application US 2010/0307008 A1 to Eric S. Zeitlin teaches a knife accessory that is an attachable knife wiper that is used by sliding the device lengthwise along the blade of a knife to remove food remnants stuck to the knife blade. The Zeitlin device, however, will get in the way of slicing and chopping of food when cutting or slicing at angles, because the device employs a bulky design that attaches itself to the knife blade by pinching the blade. This device is also potentially dangerous to the user as its oversized shape can interfere with the users line of sight when cutting, preventing the user from clearly seeing their hand placement in relation to the food being cut. It has been found that making a connection to the knife blade by creating a pinching effect causes binding and makes it difficult to slide the device along the knife blade to remove food. Furthermore, this design alters the normal operation of a knife, changing how the knife lays when it is set down and potentially alters how the users grips the knife.

U.S. Pat. No. 8,584,365 to Eric S. Zeitlin teaches a knife accessory that attaches magnetically to a knife and is used by sliding the device to remove food remnants stuck to the knife blade. This device, however, will get in the way of slicing and chopping of food because it extends beneath the knife blade cutting edge. When attached to a knife, this device does not allow for normal cutting with a knife as the entire length of the cutting edge of the knife can no longer make continuous contact with the cutting surface or material being cut due to the device extending below the knife's cutting edge. A secondary problem caused by attaching the device to the cutting edge of the knife blade is that an extra strong magnetic force is required to hold the device in place so that the device does not unintentionally fall off from the bottom edge during chopping when strong forces are exerted. The use of extra strong magnets will hinder the ability to slide the device along the knife blade to remove food, and excessive force may be required for the sliding movement that can become both dangerous and troublesome for users. Another danger that the device presents to the user is that its oversized shape can interfere with the user's line of sight when cutting, preventing the user from clearly seeing their hand placement in relation to the food being cut. Furthermore, this design alters the normal operation of a knife, changing how the knife lays when it is set down and potentially alters how the user grips the knife.

Despite these prior efforts to resolve the problem of clearing food debris from the sides of a knife blade, the problem still persists and there is a need for a more effective solution that can quickly and safely remove food debris from the sides of a knife blade.

SUMMARY OF INVENTION

In a preferred embodiment, a magnetic knife blade wiper, for use with a knife of the type having a handle, a blade made of metal that is mounted to a mounting end of the handle and having a given blade height at a maximum proximate a hilt at the mounting end of the handle between an upper blade spine and a lower blade edge, opposite side surfaces tapering edgewise respectively from the upper blade spine to the lower blade edge, and a blade length that extends along a longitudinal axis of the blade from the hilt to a knifepoint on a distal end thereof, comprises:

- a pair of wiper blades disposed approximately in parallel spaced apart by a wiper gap sufficient to enable the wiper blades to fit onto the side surfaces of the blade of the knife straddled edgewise therein, each wiper blade having an elongated shape extending perpendicular to the longitudinal axis of the knife blade with a wiper blade length that does not exceed the height of the blade at a position proximate the hilt of the knife,
- a device housing attached to upper ends of the pair of wiper blades for holding them apart in a fixed relation substantially in parallel with each other separated by the wiper gap therebetween, said device housing having a permanent magnet carried in an interior space therein, wherein said magnetic knife blade wiper is adapted for use on the knife by the pair of wiper blades being fitted proximate the hilt onto the side surfaces of the blade straddled edgewise therein, and the device housing with its permanent magnet being seated on the upper blade spine and held in magnetic attraction therewith, so that the magnetic knife blade wiper can be moved longitudinally along the blade toward the knifepoint to wipe off any food debris on the side surfaces of the blade.

Preferably, the wiper blades are of the same shape on both sides of the knife blade. The wiper blades have a length when positioned proximate the hilt of the knife that is less than the height of the blade, so that the wiper can remain in position on the knife without interfering with cutting operations. The wiper blades have a thin profile with a thickness that, when positioned proximate the hilt of the knife, is less than and does not project beyond the girth of the knife, defined as the outer boundaries of knife thickness when the knife is lying on its side on a flat surface. With this thin profile, the wiper does not interfere with cutting and does not obscure the user's sightlines around the blade when cutting with the knife.

The magnetic knife blade wiper of this invention provides a means for quickly and safely wiping off any food debris adhering to the sides of a knife blade with a single movement that saves time and is safer compared to wiping off debris with the hand or finger. The magnetic knife blade wiper can also clean off food debris by a return movement and be left attached to the spine of the knife proximate the hilt where it does not get in the way or obscure the user's sight lines for further cutting or chopping. The magnetic knife blade wiper can be sized and configured to work with any type of knife, such as a chef's knife, cook's knife, butcher's knife, kitchen knife, bread knife, paring knife, carving knife, and the like. The wiper gap and wiper blade length can be selected to accommodate a range of standard size knives.

Other objects, features, and advantages of the present invention will be explained in the following detailed description of a preferred embodiment with reference to the appended drawings.

DETAILED DESCRIPTION OF PREFERRED EMBODIMENT

In the following detailed description of the subject matter hereof, a preferred embodiment is illustrated with certain specific details of implementation. However, it will be recognized by one skilled in the art that many other variations and modifications may be made and/or practiced in analogous applications or environments. It should be noted that methods, procedures, components, or functions that are commonly known to persons of ordinary skill in the field of the invention are not described in detail herein so as avoid unnecessarily obscuring a concise description of the preferred embodiment.

Figure 1A:
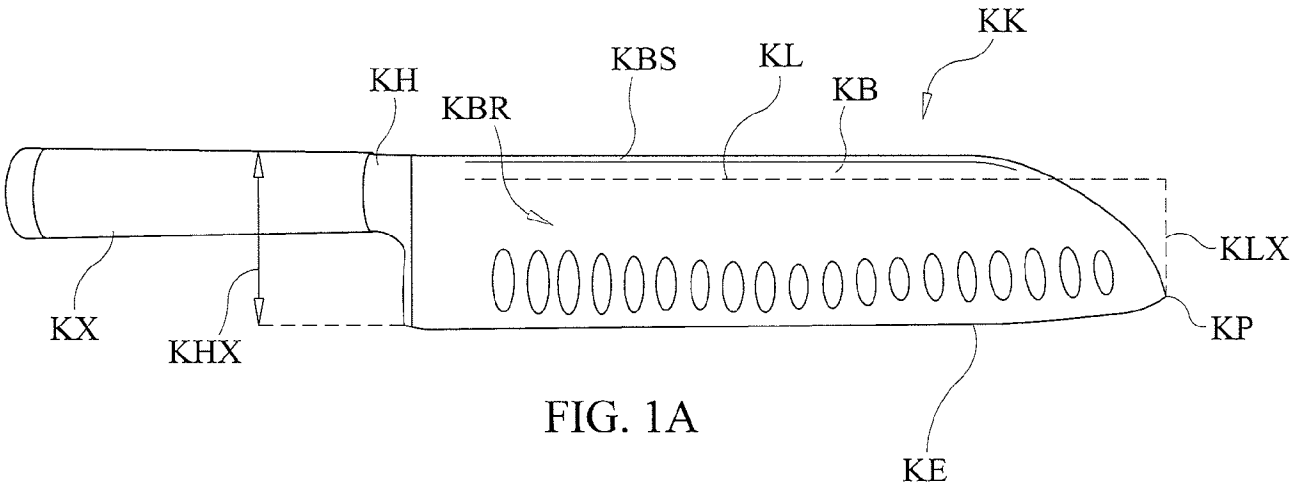
FIGS. 1A and 1B show side and top views, respectively, of a standard type of knife known as a chef's knife.
Figure 1B:
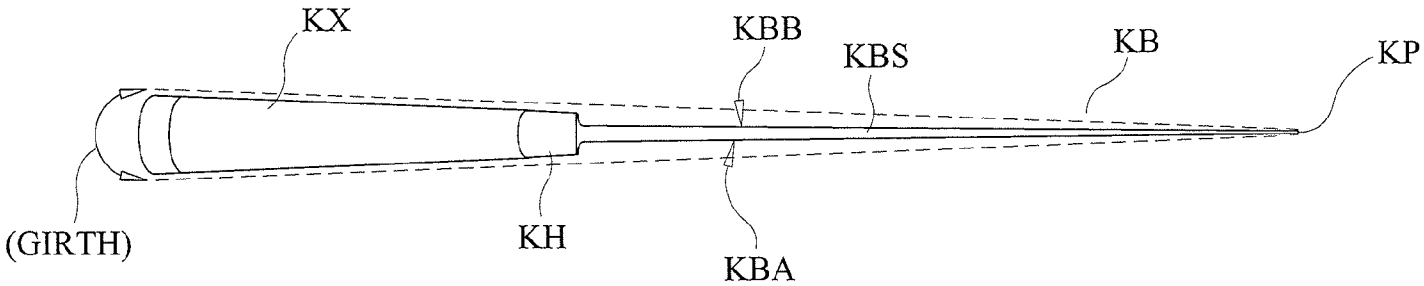

The magnetic knife blade wiper as described herein is intended for use with any standard type of knife of various sizes and shapes. In generality, as shown in FIGS. 1A and 1B, which are side and top views, respectively, a standard type of knife KK known as a chef's knife has a handle KX, a hilt KH defining a transition or coupling to a blade, a blade KB made of metal that is mounted to the handle KX by the coupling of the hilt KH. The blade has a spine KBS that is generally linear in alignment with a horizontal axis KL of the blade, a cutting edge KE, and tapers at its distal end to a knife point KP. The blade has a length KLX from hilt KH to knife point KP, and a height KHX generally defined as a maximum height of the blade at a position proximate the hilt KH of the knife. The term "girth" of the knife is generally defined by the outer boundaries (dashed lines, GIRTH) of the knife's thickness when the knife is lying on its side on a flat surface. The blade KB has generally flat, opposite side surfaces KBA, KBB (in FIG. 1B) tapering edgewise respectively from the upper spine KBS to the lower blade edge KE. The knife blade KB may have a row of scalloped recesses or dips KBR in parallel with and proximate the knife blade edge KE for reducing adhesion of cut food to the side surfaces KBA, KBB of the knife blade.

FIGS. 2A, 2B, 2C, 2D and 2E show front elevation, side elevation, top, bottom, and front perspective views, respectively, of a preferred embodiment of a magnetic knife blade wiper 10 in accordance with the present invention. The magnetic knife blade wiper 10 has an upper housing 16 and a pair of wiper blades 12, 14 extending downward from the housing 16 that are similar in shape and disposed approximately in parallel with each other. The upper ends 12*a*, 14*a* of the wiper blades are spaced apart by a wiper gap WG sufficient to enable the wiper blades to fit onto the side surfaces of a knife blade of standard size and type, such as a chef's knife with an 8-inch (203 mm) blade. The wiper blades 12, 14 have their upper ends spaced by the gap WG and their lower ends taperin together in contact with each other so that they can straddle edgewise in close contact or with a slight friction fit on the side surfaces KBA, KBB of the knife blade. The wiper blades 12, 14 are elongated in a direction perpendicular to the longitudinal axis KL of the knife blade KB with a length WL that is selected so that it does not exceed the height KHX (maximum height proximate the hilt) of the knife blade KB, and the lower ends 12*b*, 14*b* of the wiper blades 12, 14 can remain clear of the knife blade edge KE.

The magnetic knife blade wiper can be sized and configured to work with any type of knife, such as a chef's knife, cook's knife, butcher's knife, kitchen knife, bread knife, paring knife, carving knife, and the like. The wiper gap WG and wiper blade length WL can be selected for a universal fit that can accommodate a range of standard size knives, such as a wiper gap of 2 mm to 4 mm and a wiper blade length of 25 mm to 40 mm.

Figure 2E:
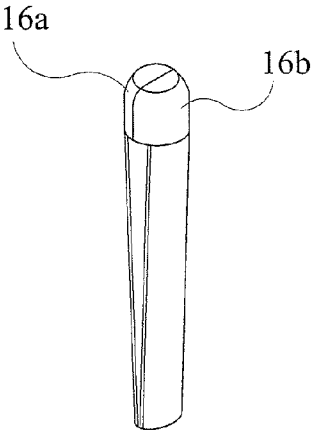
FIGS. 2A, 2B, 2C, 2D and 2E show front elevation, side elevation, top, bottom, and front perspective views respectively, of a preferred embodiment of a magnetic knife blade wiper.
Figure 2B:
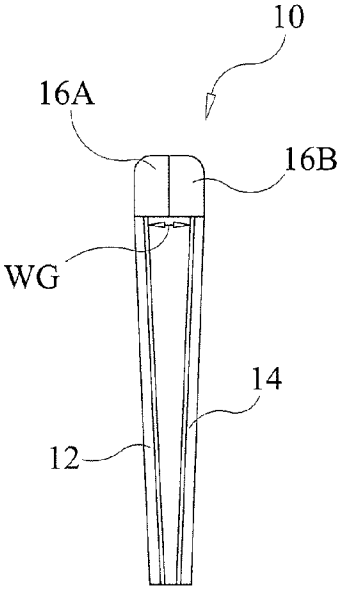
Figure 2D:
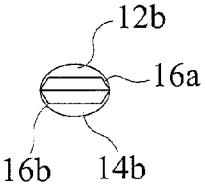
Figure 2A:
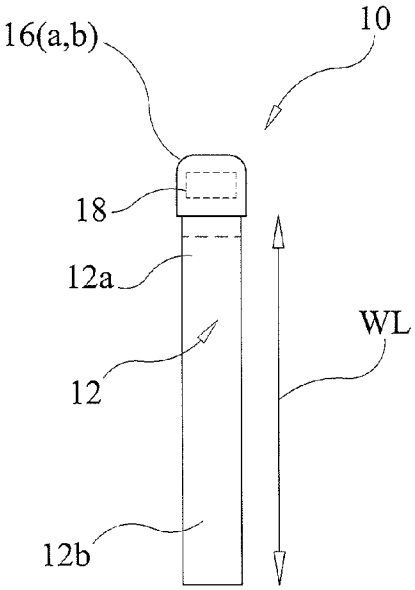
Figure 2C:
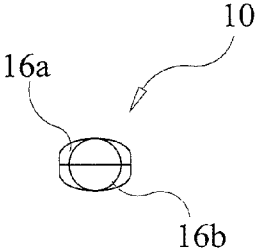

As shown in FIGS. 2C and 2D, the wiper housing may be formed in two halves 16*a*, 16*b* that are bonded or adhered together. A permanent magnet 18 is housed in a cavity within the housing 16. For ease of assembly, the two halves 16*a*, 16*b* of the wiper housing may be molded with a cavity recess formed in each half, so that the permanent magnet 18 may be inserted therein then the two halves are sealed together. The wiper blades 12, 14 taper together so that their lower ends 12*b*, 14*b* are in contact with each other.

Figure 3:
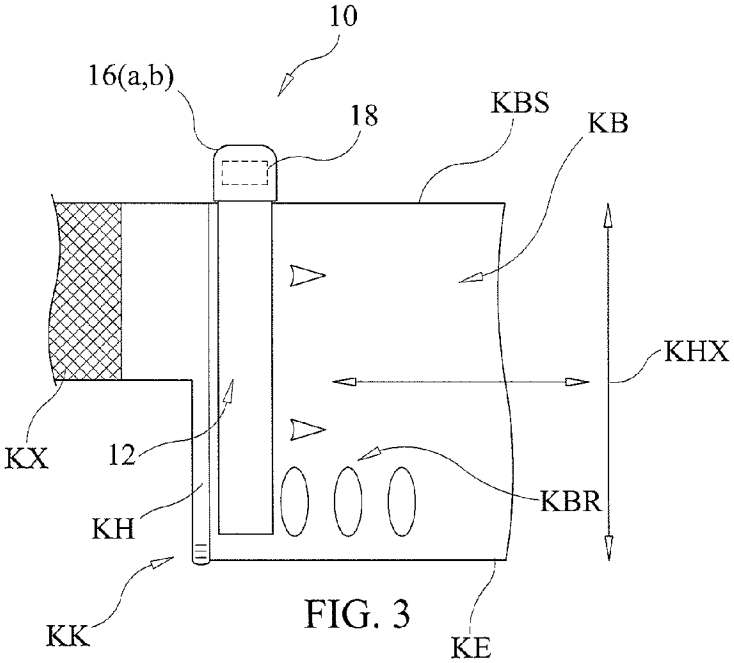
FIG. 3 is a close-up view showing the magnetic knife blade wiper in use on a knife.

FIG. 3 shows a close-up view of the magnetic knife blade wiper 10 in use on a knife KK. The wiper is installed on a knife with its pair of wiper blades 12, 14 fitted proximate the hilt KH of the blade onto the side surfaces KBA, KBB of the blade straddled edgewise therein. The device housing 16 with its permanent magnet 18 is seated on the upper blade spine KBS and held in magnetic attraction therewith. The magnetic knife blade wiper can then be moved (direction of the pair of arrows) along the longitudinal axis KL of the blade toward the knifepoint KP at the distal end to wipe off any food debris that may be adhered on the side surfaces of the blade.

The device housing 16 and wiper blades 12, 14 may be made of rigid molded plastic. The wiper blades 12, 14 may have beveled edges to leverage the scraping of food debris off the side surfaces of the knife blade. The lower ends 12*b*, 14*b* of the wiper blades may have a slight taper inclined toward each other to ensure a close fit to the lower portion of the side surfaces of the knife blade that taper toward the knife edge. The permanent magnet may be of any suitable type, including neodymium that has a high magnetic bond strength to the metal blade of the knife. The magnetic knife blade wiper is designed for quick and easy attachment onto the knife blade, as well as quick and easy removal, and furthermore can be left attached onto the knife without interfering with the normal use of the knife. It is designed to be dishwasher safe, made of commonly used kitchenware materials.

Knife blade heights typically range from 1.5" (40 mm) to 2.25" (57 mm), so the device can be manufactured in size increments for the three most common blade sizes, i.e., 1.5", 2.0" and 2.25". The neodymium magnet may be disc shaped with dimensions of ⅛" thickness by ¼" diameter. The magnet may be encased in left and right sides of the plastic housing molded with a cavity for the disc magnet to be inserted into, then the two sides of the housing are joined together through welding or thermal fusing. Alternatively, the two sides of the device housing could be joined together via other known methods, such as a snap-fit into the plastic housing, epoxy glue, screwing the housing parts together, etc.

Figure 4A:
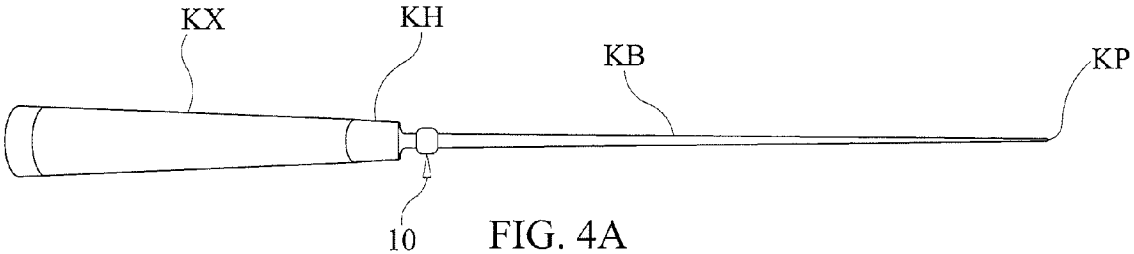
FIG. 4A is a top perspective view of the magnetic knife blade wiper in use on a knife.

FIG. 4A shows a top perspective view of the magnetic knife blade wiper 10 installed on the knife blade KB near the position of the hilt KH. Preferably, the wiper 10 is formed with blades having a thin profile of a thickness that, when positioned proximate the hilt KH of the knife, is less than and does not project beyond the girth of the knife, which is defined as the outer boundaries of knife thickness when the knife is lying on its side on a flat surface. With this thin profile, the wiper does not interfere with cutting and does not obscure the user's sightlines around the blade when cutting with the knife.

Figure 4B:
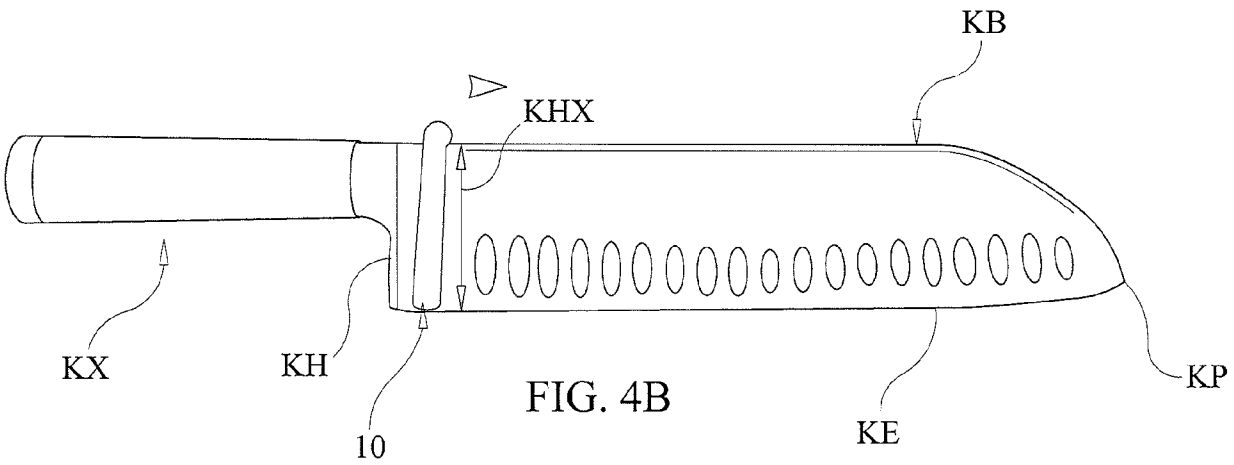
FIG. 4B is a side perspective view of the magnetic knife blade wiper positioned at the hilt of the knife.
Figure 4C:
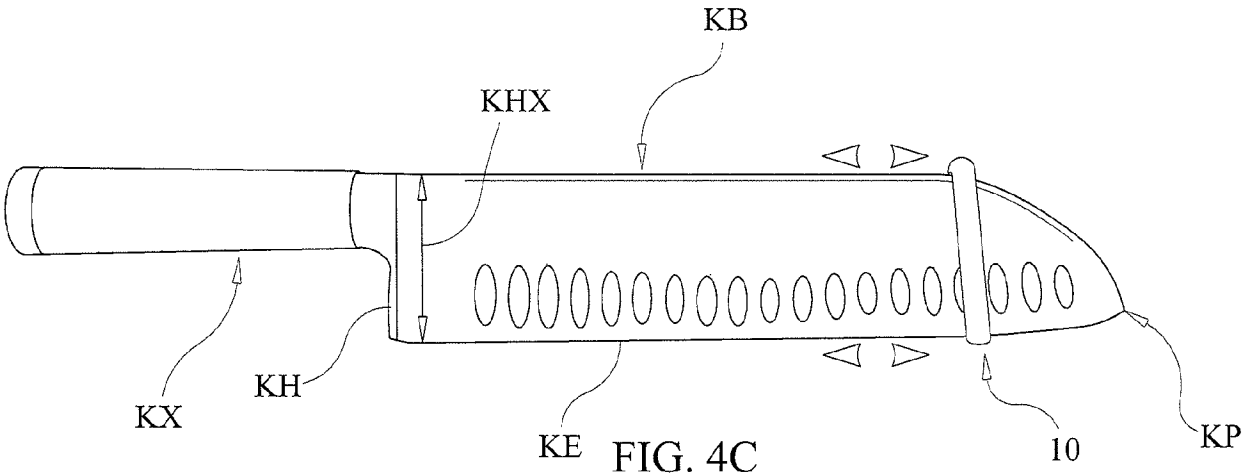
FIG. 4C is a side perspective view of the magnetic knife blade wiper moved toward the point of the knife.

FIG. 4B shows a side perspective view of the magnetic knife blade wiper 10 positioned at the hilt KH of the knife, and FIG. 4C shows a side perspective view of the magnetic knife blade wiper 10 moved toward the point KP of the knife. When the magnetic knife blade wiper 10 is slid along the spine of the knife blade KB from the handle KX toward the blade point KP, the blade wipers knock off any cut food pieces adhering to the side surfaces of the blade. Once the device reaches the knife tip, all the food debris will have been removed within a single movement of the device. The direction can be reversed so the device can be slid back toward the hilt KH where it can remain until it is needed again. As can be seen in FIG. 4B, the blade wipers of the wiper 10 at the position of the hilt KH are shorter than the blade height KHX and do not extent past the blade edge. The overall dimensions of the wiper device are made compact so that it will not impede or interfere with the cutting process or the user's sightlines and gripping and handling of the knife.

Figure 4D:
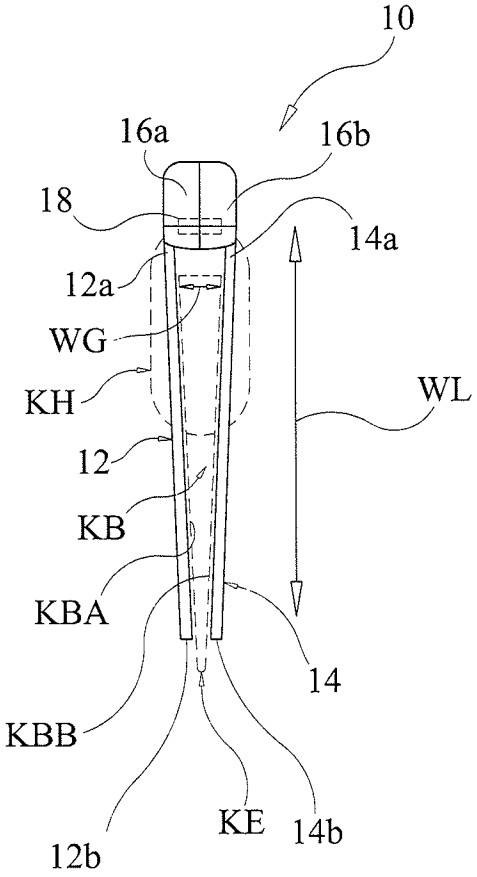
FIG. 4D is a front view of the magnetic knife blade wiper when seated on the spine of the knife.

FIGS. 4B and 4C are side perspective views of the magnetic knife blade wiper being used to remove food debris from the side surfaces of the knife. FIG. 4D is a front view of the magnetic knife blade wiper when seated on the spine of the knife. The movement of sliding the wiper device along the knife spine from the handle toward the tip is a very fast motion, which is performed within a second. During use the user holds onto the device and does not need to make direct contact to the knife blade with their finger, therefore the movement of removing food from the knife blade can be fast because the risk of cutting a finger has been removed. The magnet disc does not make direct contact with the metal knife spine because is separated by a thin portion of the plastic housing of the device that fully encases the magnet disc. By not allowing the magnet to make direct contact with the metal knife, the device is able to smoothly slide along the knife spine with minimal friction, yet there is adequate magnetic attraction to prevent the device from falling off the knife.

The following design modifications of the preferred embodiment can be made without changing the functionality of the device. Different magnet shapes and thicknesses with stronger or weaker magnetic properties may be used. The magnet can be fully encased within the plastic body of the device or covered with different materials. Different types of magnets such as ceramic magnets, ferrite magnets or Mn—Al alloy magnets could be used in place of neodymium magnets. Instead of encasing the magnet in plastic, the magnet could be exposed and allowed to make direct contact with the knife spine. The dimensions of the device can be increased or decreased in length, width and or thickness. The surfaces of the device could have any type of texture. The device itself could be made of metal or other materials instead of plastic. The device housing could comprise a single molded piece that includes both blade wipers with a cavity at the top to insert the disc magnet into and a cap to cover the top section of the disc magnet. This alternate design would allow for the magnet disc to be easily inserted in the top of the plastic housing then a cap with snap fit is used to encase the disc magnet.

Many modifications and variations may of course be devised given the above description of preferred embodiments for implementing the principles in the present disclosure. It is intended that all such modifications and variations be considered as within the spirit and scope of this disclosure, as defined in the following claims.

The invention claimed is:

1. A magnetic knife blade wiper, for use with a knife of the type having a handle, a blade made of metal that is mounted to a mounting end of the handle and having a given blade height at a maximum proximate a hilt at the mounting end of the handle between an upper blade spine and a lower blade edge, opposite side surfaces tapering edgewise respectively from the upper blade spine to the lower blade edge, and a blade length that extends along a longitudinal axis of the blade from the hilt to a knifepoint on a distal end thereof, comprises:

a pair of wiper blades disposed approximately in parallel spaced apart by a wiper gap sufficient to enable the wiper blades to fit onto the side surfaces of the blade of the knife straddled edgewise therein, each wiper blade having an elongated shape extending perpendicular to the longitudinal axis of the knife blade with a wiper blade length that does not exceed the height of the blade at a position proximate the hilt of the knife, a device housing attached to upper ends of the pair of wiper blades for holding them apart in a fixed relation substantially in parallel with each other separated by the wiper gap therebetween, said device housing having a permanent magnet carried in an interior space therein, wherein said magnetic knife blade wiper is adapted for use on the knife by the pair of wiper blades being fitted proximate the hilt onto the side surfaces of the blade straddled edgewise therein, and the device housing with its permanent magnet being seated on the upper blade spine and held in magnetic attraction therewith, so that the magnetic knife blade wiper can be moved longitudinally along the blade toward the knifepoint to wipe off any food debris on the side surfaces of the blade.

2. A magnetic knife blade wiper according to claim 1, wherein the pair of wiper blades are of the same shape on both sides of the knife blade.

3. A magnetic knife blade wiper according to claim 1, wherein the wiper blades have a length when positioned proximate the hilt of the knife that is less than the height of the blade, so that the wiper can remain in position on the knife without interfering with cutting operations.

4. A magnetic knife blade wiper according to claim 1, wherein the wiper blades have a thin profile with a thickness that, when positioned proximate the hilt of the knife, is less than and does not project beyond the girth of the knife, defined as the outer boundaries of knife thickness when the knife is lying on its side on a flat surface.

5. A magnetic knife blade wiper according to claim 1, wherein the wiper blades have their upper ends spaced by the gap and their lower ends taper together so that they can straddle edgewise in close contact or with a slight friction fit on the side surfaces of the knife blade.

6. A magnetic knife blade wiper according to claim 5, wherein the wiper gap is sized from about 2 mm to 4 mm.

7. A magnetic knife blade wiper according to claim 1, which is sized and configured to work with a chef's knife, cook's knife, butcher's knife, kitchen knife, bread knife, paring knife, carving knife, and other standard types of knives.

8. A magnetic knife blade wiper according to claim 7, wherein the wiper blade length is sized from about 25 mm to 40 mm.

9. A magnetic knife blade wiper according to claim 1, wherein the wiper housing is formed in two halves that are bonded or adhered together.

10. A magnetic knife blade wiper according to claim 9, wherein the two halves of the wiper housing are formed with a cavity recess in each half, and the permanent magnet is inserted in the cavity recesses of the two halves when bonded or adhered together.

11. A magnetic knife blade wiper according to claim 1, wherein the housing and wiper blades are made of rigid molded plastic.

12. A magnetic knife blade wiper according to claim 1, wherein the wiper blades have beveled edges for scraping food debris off the side surfaces of the knife blade.

13. A magnetic knife blade wiper according to claim 1, wherein the permanent magnet is made of neodymium or similar magnetic material of high magnetic bond strength to the metal blade of the knife.

14. A magnetic knife blade wiper according to claim 1, wherein the wiper blades have a length sized to be less than a range of knife blade heights at a maximum proximate the hilt of the knife ranging from about 1.5" (40 mm) to 2.25" (57 mm).

15. A magnetic knife blade wiper according to claim 14, formed in three size increments of wiper blade lengths for three most common blade height sizes of 1.5", 2.0" and 2.25".

* * * * *